United States Patent [19]

Klingel et al.

[11] Patent Number: 4,575,969

[45] Date of Patent: Mar. 18, 1986

[54] GRINDING MACHINE FOR PUNCHING TOOLS

[75] Inventors: Hans Klingel, Moglingen; Erich Brekle, Benningen a.N., both of Fed. Rep. of Germany

[73] Assignee: Trumpf GmbH & Co., Ditzingen, Fed. Rep. of Germany

[21] Appl. No.: 531,606

[22] Filed: Sep. 12, 1983

[30] Foreign Application Priority Data

Sep. 15, 1982 [DE] Fed. Rep. of Germany ..... 3234215

[51] Int. Cl.[4] ..... B24B 5/00

[52] U.S. Cl. ..... 51/131.1; 51/125.5; 51/127; 51/218 A; 51/218 T

[58] Field of Search ..... 51/125.5, 127, 131.1, 51/218 A, 218 T

[56] References Cited

U.S. PATENT DOCUMENTS 987,237 3/1911 Kerr ..... 51/218 A
2,548,277 4/1951 Whittlesey et al. ..... 51/127
3,852,922 12/1974 Grieco ..... 51/218 A
3,863,543 2/1975 Bottcher et al. ..... 51/127

FOREIGN PATENT DOCUMENTS 111183 11/1917 United Kingdom ..... 51/218 A

*Primary Examiner*—Frederick R. Schmidt
*Assistant Examiner*—J. T. Zatarga

[57] ABSTRACT

A surface grinding machine has a motor-driven grinding disc supported in a carrier movably supported above the base and a tool holding fixture on the base which is rotatable about a laterally offset axis. A control assembly includes a contact arm which is movable into an operative position to guide the tool into the initial grinding position, and includes means for moving the grinding disc downwardly against the tool surface in a controlled fashion upon movement of the contact arm into an inoperative position. The tool holding fixture is rotatable about its axis as the grinding disc rotates to eliminate substantially circular grooves and scratches in the tool being ground.

18 Claims, 3 Drawing Figures

GRINDING MACHINE FOR PUNCHING TOOLS

BACKGROUND OF THE INVENTION

Grinding of cutting tools such as punches and dies generally is done initially to provide the cutting surfaces and subsequently to sharpen those cutting surfaces after there has been substantial wear. Although it is possible manually to grip and move the punch or die against the surface of a grinding wheel or disc, this is generally not desirable because of the weight of some of the tools involved and because of the necessity for closely controlling the relative surface angles during such movement.

Surface grinding machines are employed for the purpose of effecting the desired grinding or sharpening operation and suitable fixtures can be utilized to support the tools at a desired angle relative to the surface of the grinding disc and to control the relative movement of the tool against the grinding surface. However, frequently the use of such surface grinding equipment will produce grooves in the surface of the tool as the disc rotates relative to the surface of the tool.

It is an object of the present invention to provide a surface grinding machine for punches, dies, and like tooling wherein tool holding fixture can rotate about an axis parallel to the axis of rotation of the grinding wheel or disc so as to avoid and substantially eliminate any circular grooves or scratches.

It is also an object to provide such a surface grinding machine in which the tool holder fixture will be rotated while the grinding disc or grinding wheel is rotated.

Another object is to provide such a grinding machine in which the workpiece fixture may be moved transversely of its axis of rotation and at an angle to the surface of the grinding disc or wheel to provide a bevelled surface on the tool.

Still another object is to provide such a machine employing a control assembly which will permit precise initial alignment of the surface of the tool to be ground with the surface of the grinding wheel and thereafter permit controlled movement of the surfaces relative to each other to effect the desired degree of grinding or sharpening.

A further object is to provide such a grinding machine in which the relative motion of the tool and grinding wheel or disc may be controlled automatically.

SUMMARY OF THE INVENTION

It has now been found that the foregoing and related objects may be readily obtained in a surface grinding machine for punches, dies, and like cutting tools which includes a base and a workpiece holder supported on the base for rotation about a vertical axis and this workpiece holder includes a support fixture for holding the cutting tool to be ground. A carrier member is supported on the base above the workpiece holder for movement relative to the base and the workpiece holder, and on the carrier is a grinding wheel assembly including a grinding disc below the carrier member which is aligned with the support fixture and a motor for rotating the grinding disc about an axis of rotation parallel to that of the workpiece holder.

In the preferred embodiments, the workpiece holder includes a base member and the support fixture is pivotably supported on the base member for pivoting about a transverse axis spaced from the axis of rotation of the grinding disc. The workpiece holder additionally includes means for pivoting the support fixture into, and for retaining the support fixture in, a plane angularly disposed relative to the axes of rotation of the holder and of the grinding disc. The axes of rotation of the grinding wheel and the workpiece holder are laterally offset from each other.

In the most desirable assembly, the grinding machine includes a control assembly on the base which comprises a guide rod seated in the carrier member and extending perpendicularly thereto at a point spaced from the axes of rotation. A contact guide arm is rotatable on the guide rod between the carrier member and the workpiece holder. This contact guide arm provides the surface against which the surface of the tool to be ground is moved, and it is thereafter pivotable into a second position to allow movement of the grinding disc against the tool surface. The carrier member is movable downwardly on its support means a distance equal to the thickness to the contact guide arm upon pivoting of the guide arm into its second or inoperative position.

Generally the control subassembly will include a cam member on the base providing a cam surface, and a cam follower on the guide rod movable thereover to effect controlled movement of the carrier member towards the workpiece holder. The control assembly will include means mounting the cam member on the base for reciprocal movement along an axis perpendicular to the axes of rotation to provide the controlled movement of the cam follower along the cam surface and thereby movement of the grinding disc relative to the workpiece holder. This cam surface will include a steep section corresponding to a distance equal to the thickness of the contact guide arm to move the grinding wheel against the associated tool and a section of relatively shallow slope to provide controlled movement of the grinding wheel thereagainst during the grinding operation. Conveniently a hydraulic actuator is used for effecting the reciprocal motion of the cam member on the base.

DETAILED DESCRIPTION OF THE ILLUSTRATED EMBODIMENT

Figure 1:
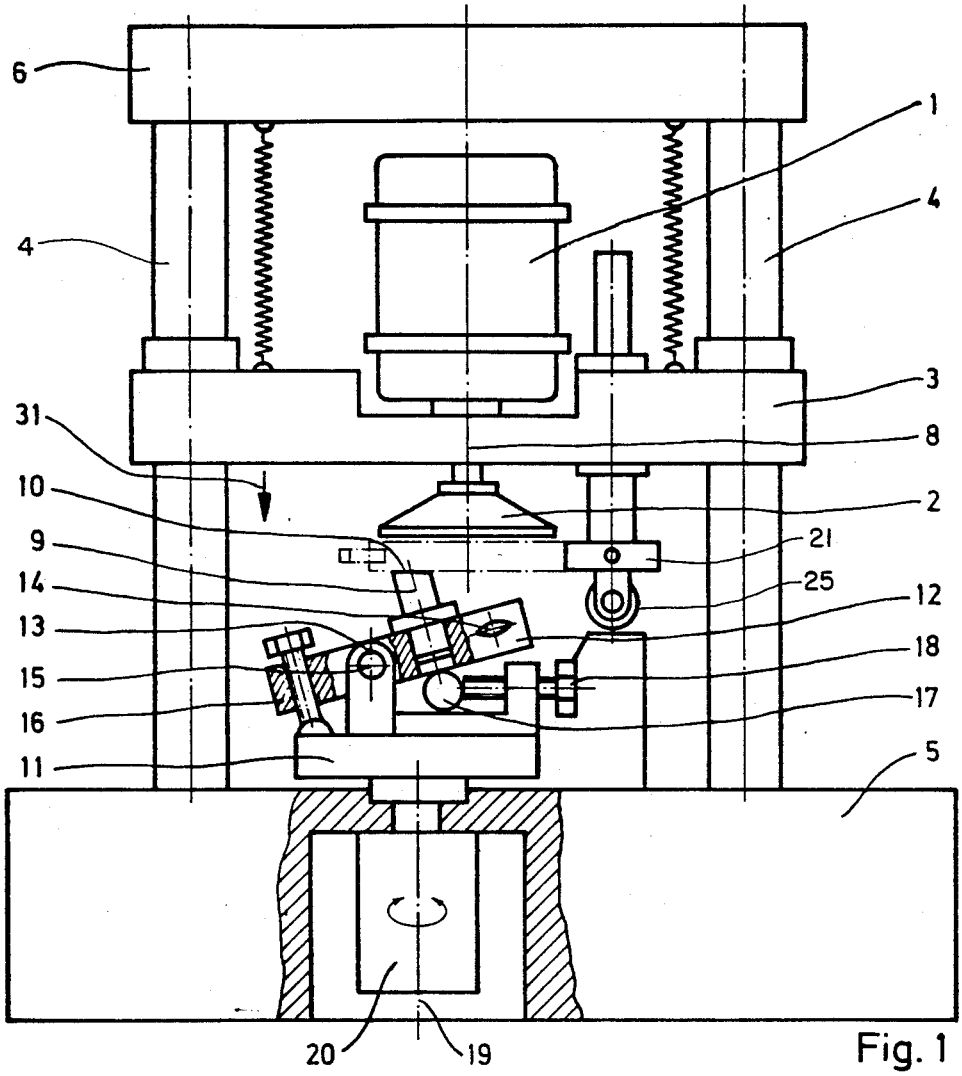
FIG. 1 is a partially schematic and partially sectional front elevational view of a grinding machine embodying the present invention.
Figure 2:
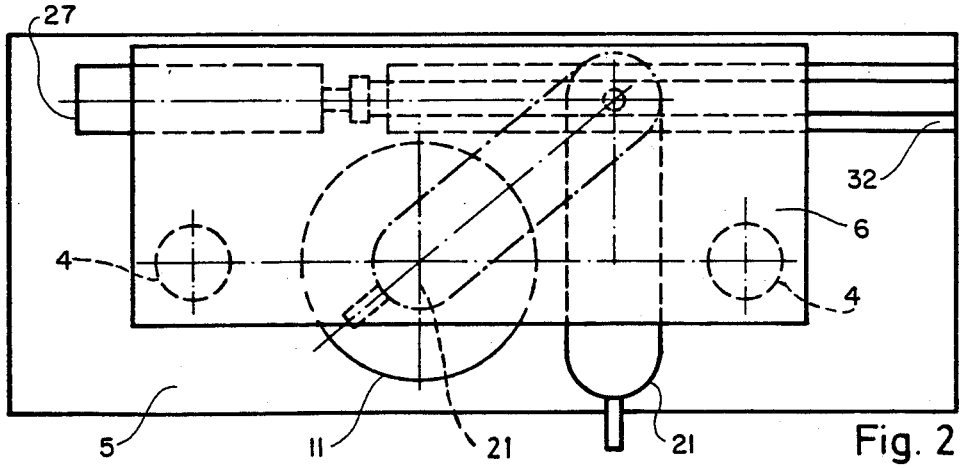
FIG. 2 is a plan view thereof.

Turning first to FIGS. 1 and 2, the key components of a surface grinding machine embodying the present invention are schematically illustrated and include a machine base 5, a pair of columns 4 supported thereon and a crossbeam 6 extending between the upper ends of the columns 4. Vertically movable on the columns 4 is a carrier member 3 which has a motor 1 mounted on its upper surface, and a grinding disc 2 below the carrier member 3 is carried by the shaft of motor 1 for rotation about a vertical axis 8.

Supported on the base 5 is a motor 20 which has its shaft rotatable about the vertical axis 19 which is parallel to and laterally offset from, the axis of rotation 8 of the grinding disc 2. Supported on the base 5 for rotation by the motor 20 is a workpiece holder or clamping fixture 11 upon which is carried the support fixture or plate 12 which is pivotably supported on a pair of upstanding lugs by the pivot pin 13 for pivotal movement about a horizontal axis 15 spaced from the axes of rotation 8 and 19.

The support fixture 12 is pivotable by rotating the support screw 18 which will move the cylindrical support 17 along the upper surface of the holder 11 towards and away from the pivotal axis 15 of the support fixture 12 so as to raise or lower its free end. Upon pivoting of the support fixture 12 into the desired position, it may be locked in position by the locking screw 16.

As seen in FIG. 1, a punch 9 comprises the workpiece or tool to be ground and it has a shank seated in a recess in the support fixture 12.

Figure 3:
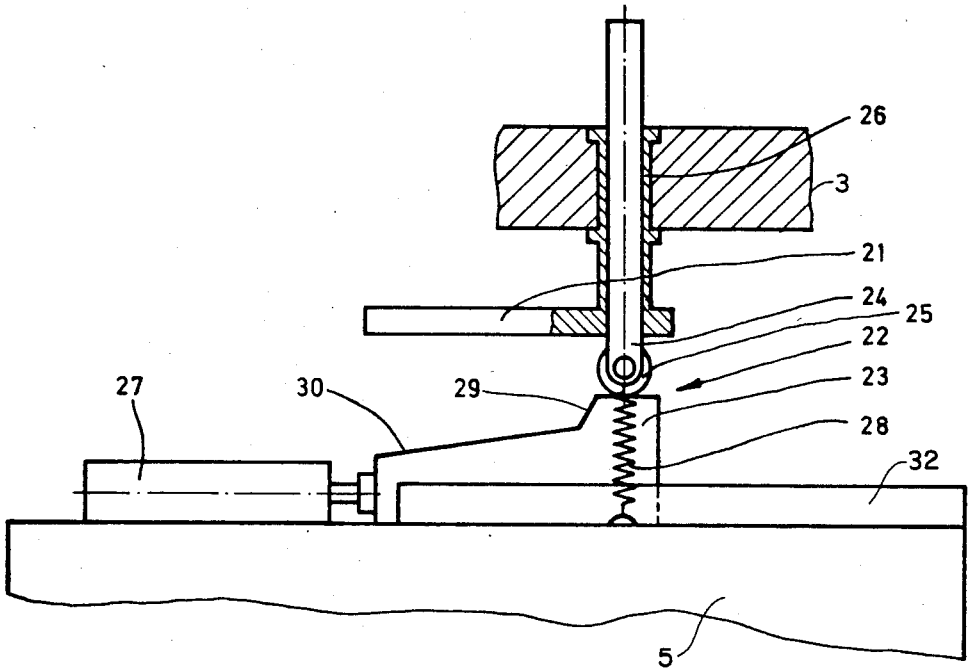
FIG. 3 is an enlarged fragmentary elevational view of the control assembly for the grinding machine.

Also mounted on the base 5 is the cam member or block 23 of the control assembly generally designated by the numeral 22 and best seen in FIG. 3. The upper surface of the cam member 23 has a steep slope portion 23 and a relatively shallow slope portion 30. The cam member 23 is slidably supported in the guideway 32 and is reciprocable therein by the hydraulic motor 27.

The control subassembly 22 also includes a contact guide arm 21 at the bottom of a collet or sleeve 26 which is rotatably seated in the carrier member 3 so as to be pivotable between the angular operative position extending to left as seen in phantom line in FIG. 2 to the inoperative position on the right as seen in FIG. 2. A small finger grip portion projects from its free end as best seen in FIGS. 1 and 2. Extending through the collet 26 is the control rod 24 which is axially slidable in the collet in the operative position of the contact guide arm 21, and a cam follower or roller 25 is rotatably supported at the lower end thereof for movement over the cam surface of the cam member 23. The control rod 24 is biased downwardly against the cam member 23 by the spring 28. Upon pivoting of the contact guide arm 21 (and collet 26) into the inoperative position, the control rod 24 is locked in the collet 26 so that the control rod 24 and carrier member 3 move in unison.

In operation of the illustrated embodiment, the tool 9 is inserted into the support fixture 12 and the contact arm 21 is pivoted to the operative position thereover (to the leftward position as seen in FIG. 2). Generally this will result in the elevation of the carrier member. The locking screw 16 is released, and then the support screw 18 is rotated to move its cylindrical support element 17 and pivot the support fixture 12 about its axis 15 until the upper surface of the tool 9 abuts the lower surface of the contact guide arm 21, as seen in FIG. 1. The support fixture 12 is then locked in this pivoted position by the locking screw 16, and the contact arm 21 is then pivoted to its inoperative position as seen in FIG. 2.

The hydraulic motor 27, when actuated, will move the cam member 23 to the right in the guideway 32. This movement causes the cam follower or roller 25 to slide down the steep slope portion 23, which produces a vertical movement downwardly of the control rod 24 and thereby the carrier member 3 a distance equal to the thickness of the contact arm 21. As a result, the surfaces of the tool 9 and grinding disc 2 come into contact. Thereafter, continued motion of the motor 27 will produce a more gradual descent of the control rod 24 and carrier member 3 for the amount of surface grinding desired.

During the grinding operation, both motors 1 and 20 operate so that the workpiece 9 is being rotated as the disc 2 rotates, thus eliminating the circular grooves or scratches which might otherwise result.

Thus, it can be seen that the surface grinding machine of the present invention comprises a novel assembly which effectively eliminates circular grooves and scratches in the workpiece and which provides simple and effective controlled grinding action beginning with initial surface contact. The machine is readily fabricated and readily adjustable to provide relatively precise grinding of beveled surfaces or flat surfaces.

We claim:

1. In a surface grinding machine for punches, dies and like cutting tools, the combination comprising:

A. a base;

B. a workpiece holder supported on said base for rotation about an axis and including a support fixture for holding the cutting tool to be ground and which is movable into angular positions relative to said base;

C. a carrier member;

D. means on said base supporting said carrier member above said workpiece holder for movement relative to said base and said workpiece holder; and E. a grinding disc assembly carried by said carrier member including a grinding disc below said carrier member and aligned with said support fixture and a motor for rotating said grinding disc about an axis parallel to that of said workpiece holder, said workpiece holder being movable to bring the surface of a tool supported therein into a predetermined position relative to said grinding disc.

2. The grinding machine in accordance with claim 1 wherein said workpiece holder includes a base member and said support fixture is pivotably supported on said base member for pivoting about a transverse axis spaced from the axis of rotation of said grinding disc, said workpiece holder additionally including means for pivoting said support fixture into, and for retaining said support fixture in, a plane angularly disposed relative to said axes of rotation.

3. The grinding machine in accordance with claim 1, wherein said axes of rotation of said grinding disc and said workpiece holder are laterally offset.

4. The grinding machine in accordance with claim 1 wherein there is included a control assembly for said grinding disc assembly including means for initially positioning said workpiece holder so that the the tool supported therein is in a predetermined plane spaced from said grinding disc and thereafter for bringing said disc rapidly into said plane to commence the grinding action.

5. The grinding machine in accordance with claim 4 wherein said control assembly includes a guide rod seated in said carrier member and extending perpendicularly thereto at a point spaced from said axes of rotation, a contact guide arm disposed between said carrier member and said workpiece holder and rotatable about the axis of said guide rod, said contact guide arm providing a surface against which the surface of the tool to be ground is movable and being pivotable into a second position to allow movement of the grinding disc against the tool surface.

6. The grinding machine in accordance with claim 5 wherein said carrier member is movable downwardly on said carrier member support means a distance equal to the thickness of said contact guide arm upon pivoting of said guide arm into said second position.

7. The grinding machine in accordance with claim 6 wherein said control assembly includes a cam member on said base providing a cam surface and a cam follower on said guide rod movable over said surface to effect controlled movement of said carrier member towards said workpiece holder.

8. The grinding machine in accordance with claim 7 wherein said control assembly includes support means mounting said cam member on said base for reciprocal movement along an axis perpendicular to said axes of rotation to provide controlled movement of said cam follower along said cam surface and thereby movement of said grinding disc towards said workpiece holder.

9. The grinding machine in accordance with claim 7 wherein said cam surface includes a steep section corresponding to said distance equal to the thickness of said contact guide arm to move the grinding disc rapidly against the associated tool and a section of relatively shallow slope to provide gradual controlled movement of the grinding disc thereagainst during the grinding operation.

10. The grinding machine in accordance with claim 8 wherein said control assembly includes a hydraulic motor for effecting such reciprocal motion of said cam member.

11. In a surface grinding machine for punches, dies and like cutting tools, the combination comprising:

A. a base;

B. a workpiece holder supported on said base for rotation about an axis and including a support fixture for holding the cutting tool to be ground and which is movable into angular positions relative to said base;

C. means for rotating said workpiece holder about said axis;

D. a carrier member;

E. means on said base supporting said carrier member above said workpiece holder for movement relative to said base and said workpiece holder;

F. a grinding disc assembly carried by said carrier member including a grinding disc below said carrier member and aligned with said support fixture and a motor for rotating said grinding disc about an axis parallel to that of said workpiece holder, said axis being laterally offset from that of said workpiece holder, said workpiece holder being movable to bring the surface of a tool supported therein into a predetermined position relative to said grinding disc; and G. a control assembly for said grinding disc assembly including means for initially positioning said workpiece holder so that the the tool supported therein is in a predetermined plane spaced from said grinding disc and thereafter for bringing said disc rapidly into said plane to commence the grinding action.

12. The grinding machine in accordance with claim 11 wherein said base member and said support fixture is pivotably supported on said base member for pivoting about a transverse axis spaced from the axis of rotation of said grinding disc, said workpiece holder additionally including means for pivoting said support fixture into, and for retaining said support fixture in, a plane angularly disposed relative to said axes of rotation.

13. The grinding machine in accordance with claim 11 wherein said control assembly includes a guide rod seated in said carrier member and extending perpendicularly thereto at a point spaced from said axes of rotation, a contact guide arm disposed between said carrier member and said workpiece holder and rotatable about the axis of said guide rod, said contact guide arm providing a surface against which the surface of the tool to be ground is movable and being pivotable into a second position to allow movement of the grinding disc against the tool surface.

14. The grinding machine in accordance with claim 13 wherein said carrier member is movable downwardly on said carrier member support means a distance equal to the thickness of said contact guide arm upon pivoting of said guide arm into said second position.

15. The grinding machine in accordance with claim 14 wherein said control assembly includes a cam member on said base providing a cam surface and a cam follower on said guide rod movable over said surface to effect controlled movement of said carrier member towards said workpiece holder.

16. The grinding machine in accordance with claim 15 wherein said control assembly includes support means mounting said cam member on said base for reciprocal movement along an axis perpendicular to said axes of rotation to provide controlled movement of said cam follower along said cam surface and thereby movement of said grinding disc towards said workpiece holder.

17. The grinding machine in accordance with claim 15 wherein said cam surface includes a steep section corresponding to said distance equal to the thickness of said contact guide arm to move the grinding disc rapidly against the associated tool and a section of relatively shallow slope to provide gradual controlled movement of the grinding disc thereagainst during the grinding operation.

18. The grinding machine in accordance with claim 16 wherein said control assembly includes a hydraulic motor for effecting such reciprocal motion of said cam member.

* * * * *